US006358297B1

(12) United States Patent
Zabala et al.

(10) Patent No.: US 6,358,297 B1
(45) Date of Patent: Mar. 19, 2002

(54) METHOD FOR CONTROLLING FLUX CONCENTRATION IN GUIDE TUBES

(75) Inventors: Robert John Zabala; Howard Roscoe Hart, Jr., both of Schenectady; Mark Gilbert Benz, Burnt Hills; Bruce Alan Knudsen, Amsterdam; William Thomas Carter, Jr., Galway; Russell Scott Miller, Ballston Spa, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/474,419

(22) Filed: Dec. 29, 1999

(51) Int. Cl.[7] ..... C22B 9/18

(52) U.S. Cl. ..... 75/10.16; 75/10.24; 266/237; 222/590

(58) Field of Search ..... 75/10.16, 10.24; 266/201, 234, 237; 222/593, 590; 373/142

(56) References Cited

U.S. PATENT DOCUMENTS

| | | | | |
|---|---|---|---|---|
| 5,160,532 A | | 11/1992 | Benz et al. | |
| 5,310,165 A | | 5/1994 | Benz et al. | |
| 5,325,906 A | | 7/1994 | Benz et al. | |
| 5,348,566 A | | 9/1994 | Sawyer et al. | |
| 5,350,159 A | * | 9/1994 | Parker | 266/237 |
| 5,472,177 A | | 12/1995 | Benz et al. | |
| 5,480,097 A | | 1/1996 | Carter, Jr. et al. | |
| 5,649,992 A | * | 7/1997 | Carter, Jr. et al. | 75/10.14 |
| 5,649,993 A | | 7/1997 | Carter, Jr. et al. | |
| 5,683,653 A | | 11/1997 | Benz et al. | |
| 5,769,151 A | | 6/1998 | Carter, Jr. et al. | |
| 5,809,057 A | | 9/1998 | Benz et al. | |
| 5,810,066 A | | 9/1998 | Knudsen et al. | |
| 5,959,016 A | * | 8/1999 | Mathiesen et al. | 266/45 |
| 5,968,447 A | * | 10/1999 | Pavlicevic et al. | 266/45 |

OTHER PUBLICATIONS

Richard J. Lewis, Hawley's Condensed Chemical Dictionary, 12th edition, p. 553, 1993.*

* cited by examiner

*Primary Examiner*—Roy King
*Assistant Examiner*—Tima McGuthry-Banks
(74) *Attorney, Agent, or Firm*—Robert P. Santandrea; Noreen C. Johnson

(57) ABSTRACT

A method for controlling electromagnetic flux concentration in a discharge guide tube for a metal refining apparatus is provided. The discharge guide tube comprises a base plate, an extension, a central orifice that extends through the extension from a source of liquid metal to an outlet in the discharge guide tube for directing a stream of metal therethrough, and an interior discharge guide tube flux concentration configuration; an induction heater system that generates an electromagnetic field in the discharge guide tube, the induction heater system being disposed on the extension with a gap defined therebetween, the induction heater system and the discharge guide tube being capable of relative vertical movement and subsequent positions with respect to each other with the gap being essentially constant. The method for providing electromagnetic flux concentration comprises providing current to the induction heater system; generating an electromagnetic field resulting from the step of providing current; and directing an electromagnetic flux to the central orifice at locations defined by the interior discharge guide tube. The step of generating an electromagnetic flux also generates heat and the step of generating heat provides a control of the flow of the stream of metal in its liquidus condition. The electromagnetic field is applied at a substantially constant level regardless of the relative vertical movement and subsequent positions between the induction heater system and the discharge guide tube.

10 Claims, 5 Drawing Sheets

METHOD FOR CONTROLLING FLUX CONCENTRATION IN GUIDE TUBES

The government may have rights in this invention pursuant to Contract No. 1457-96-01288 awarded by DARPA.

BACKGROUND OF THE INVENTION

The invention relates to methods of providing and controlling electromagnetic flux in dispensing refined metal. In particular, the invention relates to providing, controlling, and concentrating electromagnetic flux during dispensing of refined metal using a copper guide tube.

Electroslag refining is an exemplary metal refining process that is used to melt and refine a wide range of alloys, including but not limited to superalloys, for removing various impurities therefrom. U.S. Pat. No. 5,160,532, issued to Benz et al., discloses an electroslag refining apparatus that is assigned to the Assignee of the present invention, General Electric. Other ESR structure are set forth in several U.S. patents issued to the Assignee of the present invention, General Electric, including U.S. Pat. Nos. 5,310,165; 5,325,906; 5,332,197; 5,348,666; 5,366,206; 5,472,097; 5,649,992; 5,649,993, 5,683,653, 5,769,151; 5,809,057; and 5,810,066, the contents of each are incorporated herein.

In general, an electroslag refining apparatus comprises an ingot being connected to a power supply, for example one of an alternating or direct current power supply. The ingots comprise unrefined alloys that may include various defects or impurities, which are desired to be removed during the refining process to enhance its metallurgical properties, including, but are not limited to, oxide cleanliness, grain size and microstructure. The ingot forms a consumable electrode that is suitably suspended in a water-cooled crucible, which contains a slag corresponding with the alloy being refined. The slag is heated by passing an electrical current from the consumable electrode through the slag into the crucible. The slag is maintained at a suitable high temperature for melting the lower end of the consumable electrode into an ingot melt. As the consumable electrode melts, a refining action takes place with oxide inclusions in the ingot melt being exposed to the liquid slag and dissolved therein. Refined liquid melt of the ingot melt falls through the slag by gravity, which may be augmented or diminished by electromagnetic forces or other means. The liquid refined melt is collected in a liquid melt pool at the bottom of the crucible. The slag, therefore, effectively removes various impurities from the melt to effect the refining thereof. The refined melt may be extracted from the crucible by an induction-heated, segmented, water-cooled copper guide tube. The refined melt extracted from the crucible thus provides a liquid metal source for various solidification processes including, but not limited to, powder atomization, spray deposition, spray forming, investment casting, melt-spinning, nucleated-casting, strip casting, and slab casting.

In the above-described electroslag refining apparatus, the crucible can be formed of copper, and is typically water-cooled to form a solid slag and/or metal skull on its surface. The solid slag or metal skull bounds the liquid slag and prevents damage to the crucible itself. The bottom of the crucible typically includes a water-cooled, cold hearth, which can be formed of copper, against which a solid skull of the refined melt forms for maintaining the purity of the collected melt at the bottom of the crucible. A discharge guide tube assembly below the hearth can also be formed of copper. The discharge guide tube assembly is often segmented and water-cooled and allows the formation of a solid skull of the refined melt for maintaining the purity of the melt as it is extracted from the crucible. The skulls can prevent contamination of the ingot melt from contact with the parent material of the crucible.

The electroslag refining apparatus also may include a plurality of water-cooled induction heating electrical conduits that surround the discharge guide tube. The conduits inductively heat the melt and the discharge guide tube can control the discharge flow rate through the discharge guide tube. Accordingly, the thickness of the skull formed around the discharge orifice may be controlled and suitably matched with melting rates of the consumable electrode for obtaining a substantially steady state production through the discharge guide tube.

The discharge guide tube and cold hearth of some electroslag refining apparatuses are generally structurally complex, and generally comprise a plurality of fingers or segments, which are surrounded by the induction heating electrical conduits. These induction heating electrical conduits are often single piece units that are typically provided with a set configuration to conform with the configuration of the discharge guide tube. The configuration is provided to define a gap between the induction heating electrical conduits and the discharge guide tube. This configuration is suitable for heating the melt in and about the discharge guide tube in electroslag refining applications. However, if one or both of the induction heating electrical conduits and discharge guide tubes are moved with respect to one another, the gap therebetween changes due to the single-piece configuration of the induction heating electrical conduits. Therefore, the heating of the melt in and about the discharge guide tube in electroslag refining applications may be influenced, often detrimentally.

The above-described electrical conduits generate, an electromagnetic field, and an associated electromagnetic flux within the discharge guide tube, generating heat in the liquid metal stream flowing therethrough. The intensity of the generated electromagnetic field and resulting electromagnetic flux is typically related to the heating capability of the guide tube apparatus. As the electromagnetic flux intensities increase, the heating capability within the discharge guide tube increases. A high field intensity and electromagnetic flux, and resultant high heating capability in a guide tube apparatus, is often desirable for creating an initial stream of metal, melting any undesired solid metal within the electroslag refining apparatus, and superheating the stream flowing through the discharge guide tube. The electromagnetic flux intensity in the electroslag refining apparatus can be enhanced by providing at least one of a high applied voltage in the electrical conduits and an increased number of induction heating elements disposed about the electroslag refining apparatus.

Further, the configuration and structure of the electroslag refining apparatus can limit a number of induction heating elements. Further, the current amount is limited by the configuration and structure of the induction heating elements and an availability of electrical energy. Thus, the electroslag refining apparatus may be limited in its the capability to control or enhance the electromagnetic flux and thus the flow in the discharge guide tube and the heating of the metal flowing therethrough.

Accordingly, a need exists to provide a method for controlling electromagnetic flux concentration in dispensing refined metal, for example, but not limited to, dispensing refined metal from electroslag refining apparatuses.

SUMMARY OF THE INVENTION

In an aspect of the invention, method for controlling electromagnetic flux concentration in a discharge guide tube for a metal refining apparatus is provided. The discharge guide tube comprises a base plate, an extension, a central orifice that extends through the extension from a source of metal to an outlet in the discharge guide tube for directing a stream of metal therethrough, and an interior discharge guide tube flux concentration configuration; an induction heater system that generates an electromagnetic field in the discharge guide tube, the induction heater system being disposed on the extension with a gap defined therebetween, the induction heater system and the discharge guide tube being capable of relative vertical movement and subsequent positions with respect to each other with the gap being essentially constant. The method for controlling electromagnetic flux concentration comprises providing current to the induction heater system; generating an electromagnetic field resulting from the step of providing current; and directing an electromagnetic flux to the central orifice at locations defined by the interior discharge guide tube flux concentration configuration in response to the generating an electromagnetic field. The step of generating an electromagnetic flux also generates heat and the step of generating heat provides a control of the flow of the stream of metal in its liquidus condition. The electromagnetic field is applied at a substantially constant level regardless of the relative vertical movement and subsequent positions between the induction heater system and the discharge guide tube.

These and other aspects, advantages and salient features of the invention will become apparent from the following detailed description, which, when taken in conjunction with the annexed drawings, where like parts are designated by like reference characters throughout the drawings, disclose embodiments of the invention.

DESCRIPTION OF THE INVENTION

A method for controlling and concentrating flux during dispensing from a metal refining apparatus and process comprises disposing an induction heater assembly on a discharge guide tube with a gap defined therebetween. The metal refining apparatus and process comprise any appropriate metal refining apparatus and process, such as, but not limited to, an electroslag refining apparatuses and processes, vacuum-induction metal apparatuses and processes, induction melt apparatuses and processes, electron beam cold hearth apparatuses and processes, plasma arc apparatuses and processes, vacuum arc remelting apparatuses and processes, and others. The following description will refer to electroslag refining apparatuses and processes as exemplary refining apparatuses and processes in which refined metal is dispensed therefrom. This refining apparatus and process is merely for description purposes, and other metal refining apparatuses and processes are within the scope of the invention.

The discharge guide tube comprises an interior discharge guide tube flux concentration configuration concentrating electromagnetic flux and consequent heating of a stream of refined metal flowing through a central orifice in the discharge guide tube. The method, as embodied by the invention, will be described hereinafter with respect to a configuration of an electroslag refining apparatus 10 and discharge guide tube 22.

Figure 1:
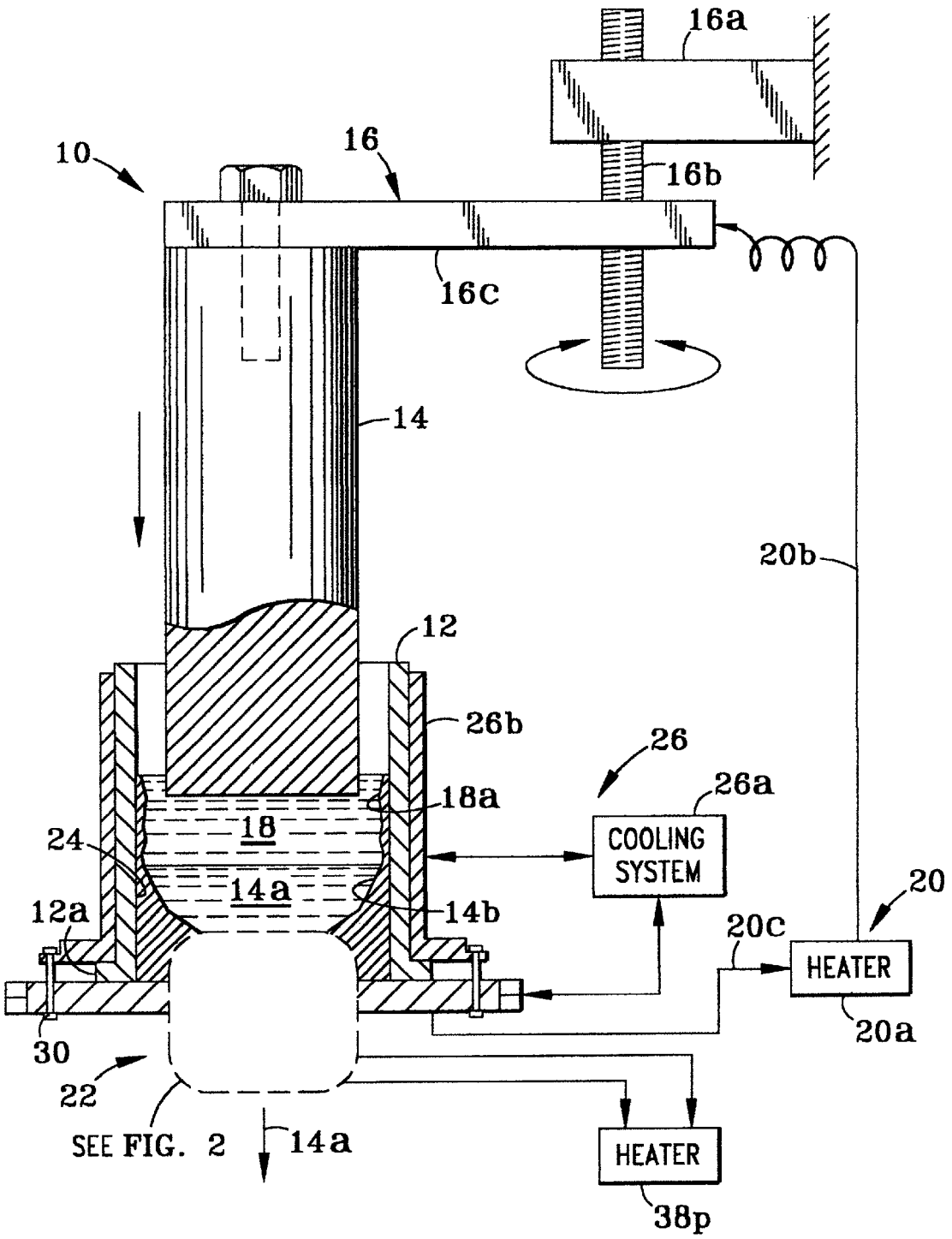
FIG. 1 is a schematic illustration of an electroslag refining apparatus for a method, as embodied by the invention.
Figure 2:
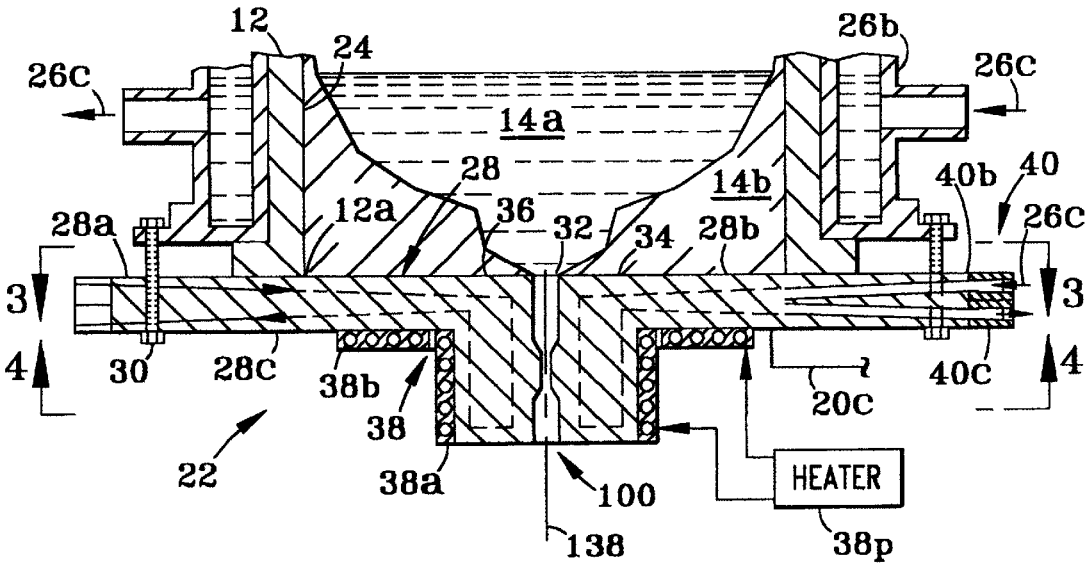
FIG. 2 is a schematic illustration of a discharge guide tube for a method, as embodied by the invention.

An electroslag refining apparatus 10 for conducting the method, as embodied by the invention, is schematically illustrated in FIGS. 1 and 2. The electroslag refining apparatus 10 comprises a cylindrical crucible 12 in which an ingot 14 (also known in the art as a "consumable electrode"), which is to undergo electroslag refining, is suspended. A feed device 16 is provided for feeding the consumable electrode 14 into the crucible 12 at a suitable feed rate, as known in the art. The feed device 16 includes, but is not limited to, a suitable drive motor and transmission 16*a,* that rotate a screw 16*b* that in turn lowers, or translates downwardly, a support bar 16*c* that is fixedly joined at one end to the top of the consumable electrode 14. Although the illustrated configuration of the electroslag refining apparatus 10 illustrates a consumable electrode 14 as the source of metal to be electroslag refined, the scope of the invention comprises other suitable sources, such as but not limited to a powder source or a liquid metal source.

The consumable electrode 14 comprises a suitable alloy to be electroslag refined, in which the alloy comprises nickel-, iron-, iron-nickel-, or cobalt-based alloy or superalloy. A slag 18 is provided inside the crucible 12. The slag 18 comprises any suitable composition for refining the consumable electrode 14. A heater device 20 is provided for melting the tip of the consumable electrode 14 as the consumable electrode 14 is fed into the crucible 12. The heater device 20 includes a suitable electrical current power supply 20*a* that is electrically connected to the consumable electrode 14. The heater supply 20*a* is connected to the consumable electrode 14 through the supporting bar 16*c,* for example by an electrical lead 20*b*. Electrical current is carried through the consumable electrode 14, and through the liquid slag 18 to the crucible 12. Therefore, the slag 18 is resistively heated to a temperature that is suitable to melt the bottom end of the consumable electrode 14. Although the illustrated configuration of the electroslag refining apparatus 10 illustrates a consumable electrode 14 as the source of electrical current, the scope of the invention comprises other suitable sources, such as but not limited to an unconsumed electrode.

A copper discharge melt guide 22 is removably attached to a bottom 12*a* of the crucible 12. The discharge melt guide 22 comprises a central orifice 32 that includes a configuration to concentrate electromagnetic flux in the central orifice 32, so as to more efficiently heat metal therein, as described hereinafter. The discharge melt guide 22 encloses the bottom of the crucible 12. An electrical path can be provided between the power supply 20*a* by an electrical lead 20*c*. The slag 18 is heated by the power supply 20*a,* and this heating causes a bottom tip of the consumable electrode 14 to be correspondingly heated and melted. Liquid refined melt of molten metal, or simply liquid refined melt 14*a* from the consumable electrode 14 is formed. The liquid refined melt 14*a* falls through the slag 18 and collects in a liquid metal pool or reservoir 24, which is disposed at the bottom of the crucible 12.

The electroslag refining apparatus 10 includes a cooling system 26 that cools the crucible 12 during operation of the electroslag refining apparatus 10. The cooling system 26 can comprise a coolant supply 26*a* that is effective for pumping a coolant 26*c*, such as, but not limited to water, through a cooperating cooling jacket 26*b* that is disposed around the crucible 12. The crucible 12 and cooling jacket 26*b* may be an integral assembly. Alternatively, the crucible 12 and cooling jacket 26*b* may be discrete components connected together in thermal cooperation. The cooling jacket 26*b* includes suitable channels or conduits that extend therethrough, and coolant 26*c* is circulated for removing heat from the crucible 12 during operation of the electroslag refining apparatus 10.

A solid slag skull 18a can form inside the crucible 12 around the liquid slag 18. The solid slag skull 18a can isolate the crucible 12 from the liquid slag 18 and the metal that can fall through the electroslag refining apparatus 10. Electroslag refining of the consumable electrode 14 occurs as the metal liquid refined melt 14*a* are exposed to the slag 18. The slag 18 dissolves inclusions, such as but not limited to oxide inclusions and nitrogen inclusions, from the liquid refined melt 14*a*.

The crucible 12, which typically comprises copper, is isolated from the refining process by the solid slag skull 18*a*. Therefore, the crucible 12 does not contaminate the ingot melt 14*a*. The refined melt collects in the reservoir 24 at the bottom of the crucible 12. The ingot skull 14*b* isolates the refined melt from the crucible 12 and prevents contamination of the melt by the crucible 12. During operation, the liquid slag 18 floats atop the pool of refined melt that is collected above the discharge melt guide 22.

The discharge melt guide 22 is illustrated in FIG. 2, is configured to generate, electromagnetic flux intensity and concentration of heating when compared to conventional melt guides, such as in U.S. Pat. No. 5,809,057, to Benz, which is assigned to the Assignee of the instant invention and fully incorporated herein. It has been determined that the amount of induction heating in the discharge guide tube is generally proportional to the square of the applied electromagnetic field, and that with the interior discharge guide tube flux concentration configuration, as described hereinafter, provides electromagnetic flux in a substantially constant levels with changes in coil position.

FIG. 2 provides an enlarged view of the discharge melt guide 22 enclosing the bottom 12*a* of the crucible 12. In FIG. 2, the crucible 12 comprises a solid cylindrical member, with its bottom 12*a* formed as an annular radial flange. The coolant jacket 26*b* comprises a double-walled cylinder that surrounds the crucible 12. The coolant jacket 26*b* is hollow for receiving the coolant 26*c* for cooling the crucible 12.

The discharge melt guide 22 comprises a substantially flat base plate 28. The base plate 28 can be formed from an appropriate heat and electrically conductive material, such as but not limited to, copper. The base plate 28 comprises a circular disk that is complementary to the configuration of the crucible 12, and comprises an upper perimeter 28*a* with a diametrical portion that engages the crucible bottom 12*a*. Thus, the discharge guide tube 22 can form a sealed attachment to the crucible 12. Also, fasteners 30, for example a plurality of circumferentially spaced apart bolts and cooperating nuts, can removably attach and seal the base plate 28 to the crucible bottom 12*a*. In FIG. 2, the fasteners 30 extend through apertures in the perimeter of the base plate 28 that are aligned with apertures disposed in a suitable annular flange around the base of the coolant jacket 26*b*. A gasket, or other such sealing element, may be provided between the base plate 28 and the crucible bottom 12*a* to be compressed therebetween upon assembly of the fasteners 30 that secure the base plate 28 to the bottom of crucible 12.

The base plate 28 of the discharge guide tube 22 comprises an upper surface 28*b*, which together with the crucible 12, defines the reservoir 24 for receiving and pooling liquid refined melt 14*a*. The base plate 28 also comprises an external or lower surface 28*c* that is spaced below the upper surface 28*b*. In FIG. 2, both surfaces 28*b* and 28*c* are illustrated as substantially flat and parallel to each other. This illustrated configuration is merely exemplary and is not intended to limit the invention in any way. The scope of the invention includes other configurations of these features, such as not limited to, concave, convex, arcuate, and combinations thereof, with or without flat and parallel features.

The base plate 28 also comprises includes a central orifice 32 (also known in the art as a "discharge guide tube orifice") formed in an extension 29 that extends to an outlet 100. The central orifice 32 extends generally vertically through the base plate 28 between its upper and lower surfaces, 28*b* and 28*c* respectively. The central orifice 32 allows refined melt 14a to be drained from the reservoir 24, for example, and in no way limiting of the invention, by at least one of gravity flow, pressure-induced flow, and vacuum-induced flow on the bottom of the refined melt 14*a*. The discharge melt guide 22 comprises a central orifice 32 that includes an interior discharge guide tube flux concentration configuration to enhance heating, by concentrating electromagnetic flux in the central orifice 32, as described hereinafter.

Figure 3:
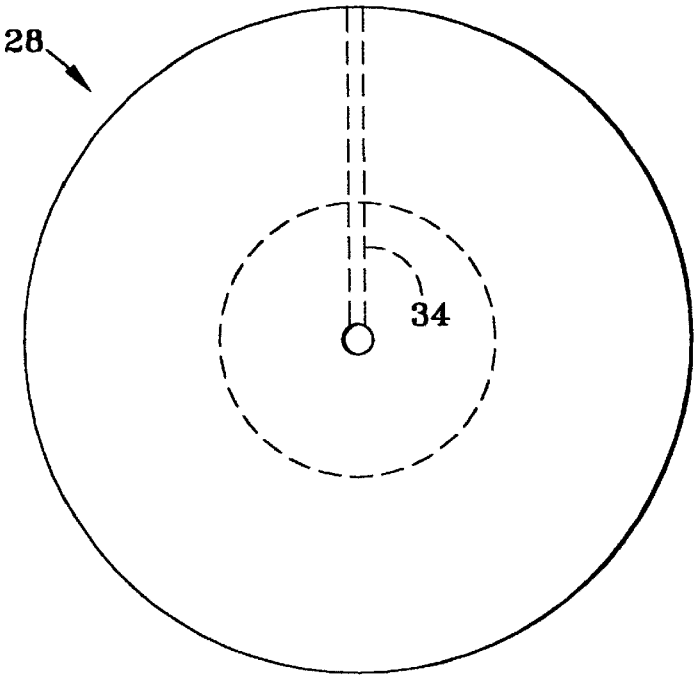
FIG. 3 is a bottom illustration of a discharge guide tube for a method, as embodied by the invention.

The base plate 28 comprises at least one slot 34 formed therein, as illustrated in FIG. 3. Each slot 34 can extend vertically through the base plate 28. Each slot 34 directs the electromagnetic flux in the electroslag refining apparatus, as described hereinafter. The base plate 28 may alternatively comprise a plurality of spaced apart slots 34, for example slots that are equiangularly, circumferentially spaced from each other, and that extend radially outwardly from the orifice 32 toward the perimeter of the base plate 28.

Figure 4:
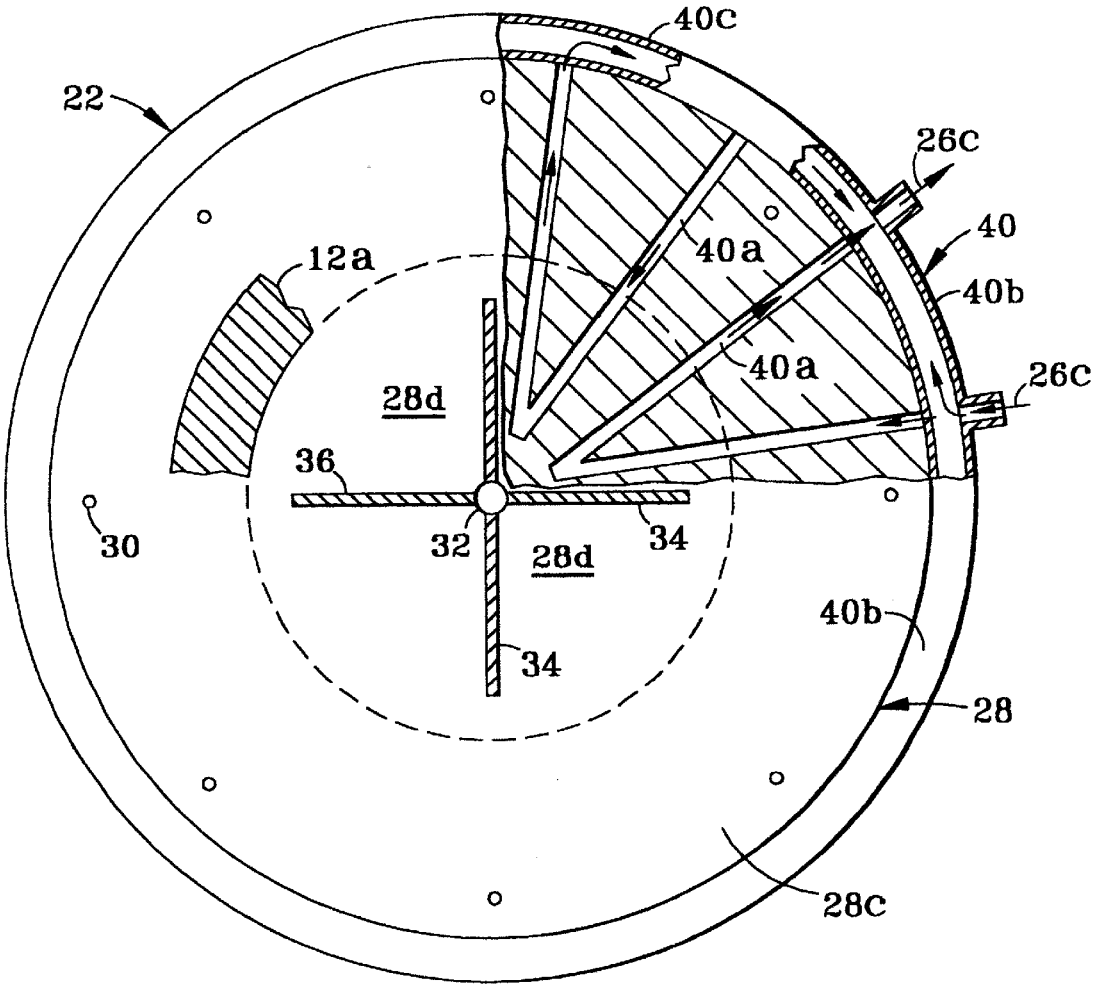
FIG. 4 is a top, partial section illustration of a discharge guide tube of FIG. 2 taken along line 3—3.

A plurality of equiangularly, circumferentially spaced slots 34 are illustrated in FIG. 4. In FIG. 4, four slots 34 are illustrated as being disposed about 90 degrees apart from each other, however, this configuration is merely exemplary of the slot configurations within the scope of the invention. The scope of the invention comprises any suitable number of slots 34 in the base plate 28. The slots 34 may also be formed using electrodischarge machining (EDM). Alternatively, other known metallurgical processes may be used to form the slots 34, and are within the scope of the invention. The slots 34 can be gas filled, or filled with an electrical insulation 36, such as, but not limited to, an epoxy polymer.

The slots 34 define a plurality of arcuate segments or fingers 28*d*. The illustrated configuration (FIG. 4) shows four fingers 28*d* (alternatively referred to as "segments") defined between the slots 34. The cooling system 40 for the base plate 28 can comprise channels 40*a* that extend inside each of the fingers 28*d* for circulating a coolant 26*c* therethrough. The cooling system 40 can be provided with its own source of coolant. Alternatively, the cooling system 40 may be disposed in parallel with the cooling supply 26*a*, and use the coolant that cools the crucible 12. This configuration is merely exemplary of the scope of the invention and is not intended to limit the invention in any manner. Each finger 28*d* can comprise an approximate 90-degree corner. The cooling channels 40*a* in the discharge guide tube 22 may be formed by drilling cylindrical holes radially inwardly from the outer perimeter of the base plate 28. Adjacent channels 40*a* may be disposed therein to converge radially inwardly and intersect near the central orifice 32, thus providing supply and return paths for coolant flow.

In the illustrated exemplary embodiment of FIGS. 2 and 4, the cooling system 40 also includes a pair of coolant manifolds 40*b* and 40*c,* which may be integrally formed with the base plate 28. Alternatively, the manifolds 40*b* and 40*c* may be attached around the perimeter of the base plate 28, with the supply manifold 40*b* being disposed in communication with a channel 40*a* for supplying the coolant. The return manifold 40*c* may be disposed in communication with channels 40*a* for receiving return coolant. The manifolds 40*b* and 40*c* can be connected to the coolant supply 26*a* for circulating the coolant.

The discharge melt guide 22 comprises an induction heater system 38. The induction heater system 38 is disposed proximate and below the base plate lower surface 28*c* for induction heating the refined melt 14*a.* The term "proximate" means near or close to, and is used with a meaning as understood by those of skill in the art with its conventional meaning. The electromagnetic flux generated by the induction heater system 38 can be transmitted to those and other elements of the electroslag refining apparatus 10, resulting in heating as desired . The induction heater system 38 may take any conventional configuration including, but not limited to, an annular or spiraling induction heater system configuration.

The coils of the induction heater system 38 can be disposed coaxially about the central orifice 32 and can extend radially over the slots 34. As illustrated in FIG. 1, the induction heater system 38 can include one or more suitable power supplies 38*p* that provide electrical current that is sufficient for induction heating. The induction heating coils can comprise hollow coils that circulate a suitable coolant, such as, but not limited to, water.

Figure 6:
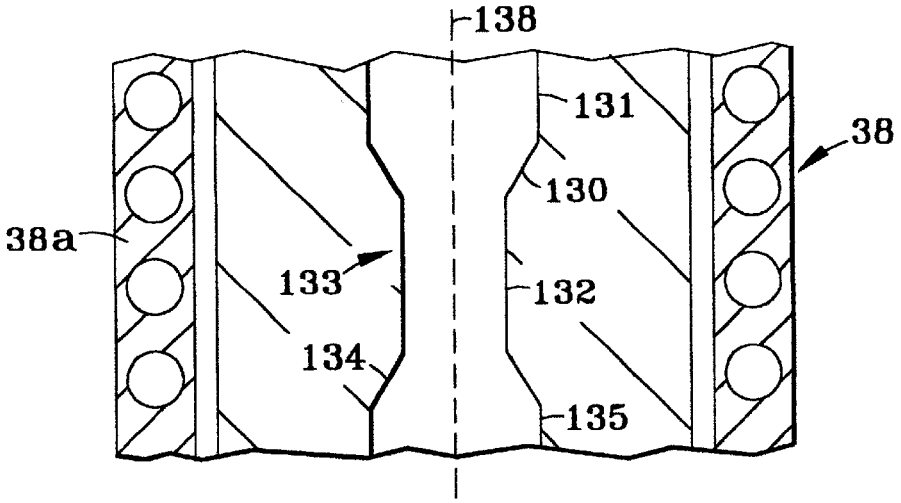
FIG. 6 is a schematic, partial section detailed illustration of a discharge guide tube of FIG. 1 for a method, as embodied by the invention.

The induction heater system 38 can comprise primary coils 38*a,* which are generally co-axial with the central orifice 32 along the extension 29, and secondary coils 38*b* that are generally disposed on surface 28*c* of the base plate 28. The induction heater system 38 is disposed on the extension 29 of the discharge melt guide 22 to define a gap therebetween. The disposition of the induction heater system 38 on the extension 29 allows movement of induction heater system 38 in the direction of arrow 500 (FIG. 6) with the gap remaining constant. The constant nature of the gap allows generated heat, and electromagnetic flux from the induction heater system 38 to be substantially unaffected by movement of the induction heater system 38 in the direction of arrow 500. The term "substantially" is used with its normal meaning as understood by those of skill in the art.

The primary coils 38*a* and secondary coils 38*b* of the induction heater system 38 may define independent primary and secondary coils, 38*a* and 38*b,* respectively. Alternatively, the primary coils 38*a* and secondary coils 38*b* may be connected to create an integral coil structure for the induction heater system 38. The primary coils 38*a* and secondary coils 38*b* may take any appropriate coil configuration and structure, such as, but not limited to, water-cooled, current-carrying conduit coils. For example, the primary coils 38*a* and secondary coils 38*b* may be overlapped at at least one portion, such as but not limited to, coiled onto themselves. The illustrated configurations are merely exemplary of the structures within the scope of the invention, and are not intended to limit the invention in any manner.

The primary coil 38*a* of the induction heater device 38*p* can be disposed adjacent to and surrounding the central orifice 32 for heating the refined melt 14*a* that is discharged therethrough, as embodied by the invention. The primary coil 38*a* may also control a thickness of the corresponding skull 14*b* that is disposed proximate the central orifice 32. The secondary coils 38*b* can be spaced radially outwardly from the primary coil 38*a,* and may radially overlap (not illustrated). The secondary coil 38*b* can comprise a sufficient number of turns for sufficiently heating the refined melt 14*a* around and in the central orifice 32. The secondary coils 38*b* can also control a thickness of the ingot skull 14*b,* as described above.

Figure 5:
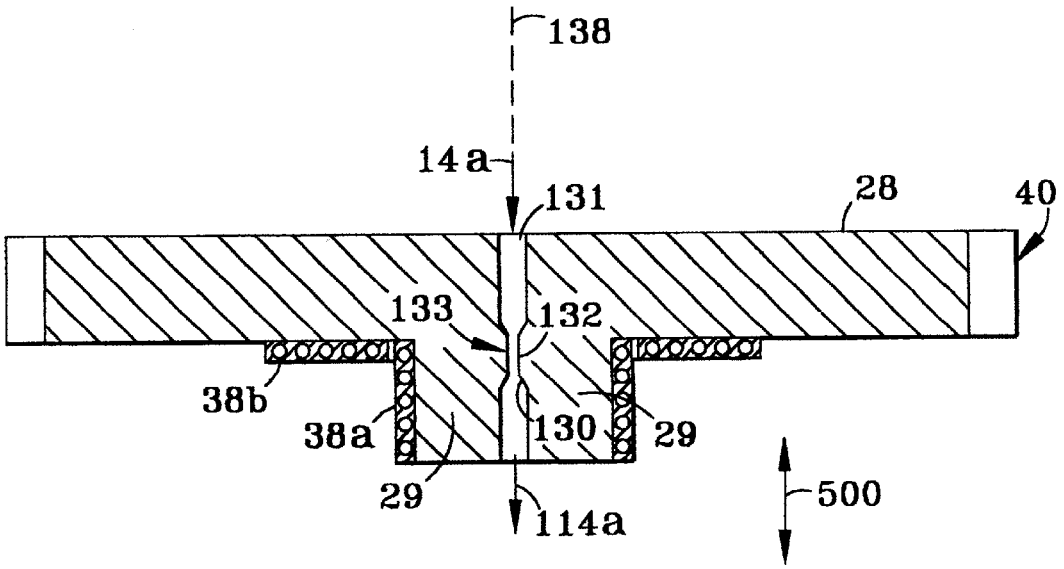
FIG. 5 is a schematic, partial section illustration of a discharge guide tube for a method, as embodied by the invention.

The central orifice 32 of the discharge guide tube (also known as a "discharge guide tube") 22 comprises an internal configuration with a profile that concentrates heat, electromagnetic field, and electromagnetic flux (hereinafter "heat and electromagnetic flux" since the electromagnetic flux is produced by the electromagnetic field) to the stream of liquid melt that flows therethrough. As illustrated in FIG. 2 and in detail in FIGS. 5 and 6, the central orifice 32 comprises an angled and stepped profile about a central longitudinal axis 138 of the central orifice 32. The stepped and angled profile can be formed by an inclined (first) central orifice ramp portion 130 that extends from a first central orifice portion 131 to a reduced diameter central orifice portion 132, which defines a constriction 133, and then to another (second) inclined central orifice ramp portion 134, which in turn leads to a further (second) central orifice portion 135. The diameter of the second central orifice portion 132 is less that the diameter of the first central orifice portion 131. In other words, the ramp portion leads to a constriction 133 in the central orifice 32 at which point the flux concentration in the central orifice 32 is higher than at other portions of the central orifice 32, such as at the first central orifice portion 131.

The configuration of the central orifice 32 at which the constriction 133 is formed can comprise any appropriate configuration that can produce the concentrations of electromagnetic flux, as embodied by the invention. The angles for the inclined central orifice ramp portion 130 and 134 can comprise any angles that form the constriction 133. The lengths of the inclined central orifice ramp portions 130 and 134 can be equal. Alternatively, lengths of the inclined central orifice ramp portions 130 and 134 need not be equal. Further, the length of the second central orifice portion 132 may vary. Also, the positioning of the second central orifice portion 132, and thus the constriction, in the central orifice 32 may vary. For example, the positioning of the second central orifice portion 132 and the constriction in the central orifice 32 may equi-spaced in the central orifice 32, be disposed closer to the electroslag refining apparatus 10 than an exit from the central orifice 32, or be disposed closer to the exit from the central orifice 32 than to the electroslag refining apparatus 10. Accordingly, the positioning and configuration of the features of the central orifice 32 to produce the heat and electromagnetic flux can vary, as long as the intended purpose of the invention is accomplished.

The central orifice 32, including the ramp portion 130 that extends from a first central orifice portion 131 to a second central orifice portion 132, may be formed by any metallurgical machining suitable process. The scope of the invention includes forming the central orifice 32 by a machining processes, such as, but not limited to, at least one of drilling, lathe turning, and electrodischarge machining (EDM). If drilling is used to form the central orifice 32, a drilling process provides a passage, which has a diameter that generally equal to that of the constriction 133, and larger diameters at the first central orifice portion 131 may be provided by further drilling. Thus, the central orifice 32 is formed to be generally perpendicular to the upper and lower surfaces, 28*b* and 28*c* respectively, of the base plate 28. Therefore, the liquid refined melt 14*a* can flow straight downwardly by gravity from the central orifice 32 during electroslag refining operations. The above-described drilling is merely exemplary of formation processes within the scope of the invention, and other formation processes can be used herein.

The induction heating system 38 is disposed along the lower surface 28*c* of the base plate 28 in a generally concentric configuration to be disposed around the central orifice 32. The coils of the induction heating system 38 are also disposed over the radial extent of the slots 34 for transmitting electromagnetic energy into the melt 14*a*. The heat and electromagnetic flux are transmitted to the constriction 133 in the central orifice 32 in amounts sufficient to maintain the stream of refined liquid melt 14*a* that is flowing through the central orifice 32 in a liquidus state for continued flow through the central orifice 32, as embodied by the invention. Further, the heat and electromagnetic flux can control the flow of refined liquid melt through the central orifice 32, as embodied by the invention. For example, if higher heat and electromagnetic flux is applied to the electroslag refining apparatus 10, more refined liquid melt 14*a* will remain in a liquidus state, and less liquid refined melt 14*a* will solidify into the skull 14*b*. Further, some of the skull 14*b* proximate the central orifice 32 will melt, by the application of the heat and electromagnetic flux, so restrictions around the central orifice 32 will be reduced. Thus, flow through the central orifice 32 will be facilitated, and less skull 14*b* will be formed.

Conversely, the flow through the central orifice 32 can be lessened by reducing the amount of heat and electromagnetic flux that is applied to the electroslag refining apparatus 10, as embodied by the invention. With less electromagnetic field generating less heat, there will be less concentrated electromagnetic flux at the constriction 133 in the central orifice 32. Less electromagnetic flux at the constriction 133 will slow flow of the liquid refined melt 14*a* through the central orifice 32. Thus, an amount of time that the liquid refined liquid melt 14*a* is in contact with the skull 14*b* increases, and with more time in contact with the skull 14*b*, the refined liquid melt 14*a* may solidify against the skull 14*b*. Accordingly, more skull 14*b* may form around the area at the central orifice 32 and restrict flow into and through the central orifice 32, thereby controlling the flow in the electroslag refining apparatus 10. The heat melts the skull may reach a limit that is bounded by the generated electromagnetic flux. At a point in the generation of the heat, the electromagnetic flux may cause a field constriction in the central orifice 32 that may limit flow. The configuration of the central orifice 32 and the interior discharge guide tube flux concentration configuration defines the electromagnetic flux amount at which point the electromagnetic flux will cause restriction in the central orifice 32. Thus, further control on the flow through the central orifice 32 can be realized.

For example, and in no way limiting the invention, the flow of the refined melt 14*a* through the central orifice 32 may also be controlled, so as to be approximately equal to the melt rate of metal from the consumable electrode 14. Accordingly, a generally steady-state flow in the electroslag refining apparatus 10 can be provided. The induction heating of the liquid refined melt 14*a* through the slots 34, and cooling of the base plate 28 around the central orifice 32, can be provide a balanced flow relationship during startup and steady-state operations of the electroslag refining apparatus 10.

Figure 7:
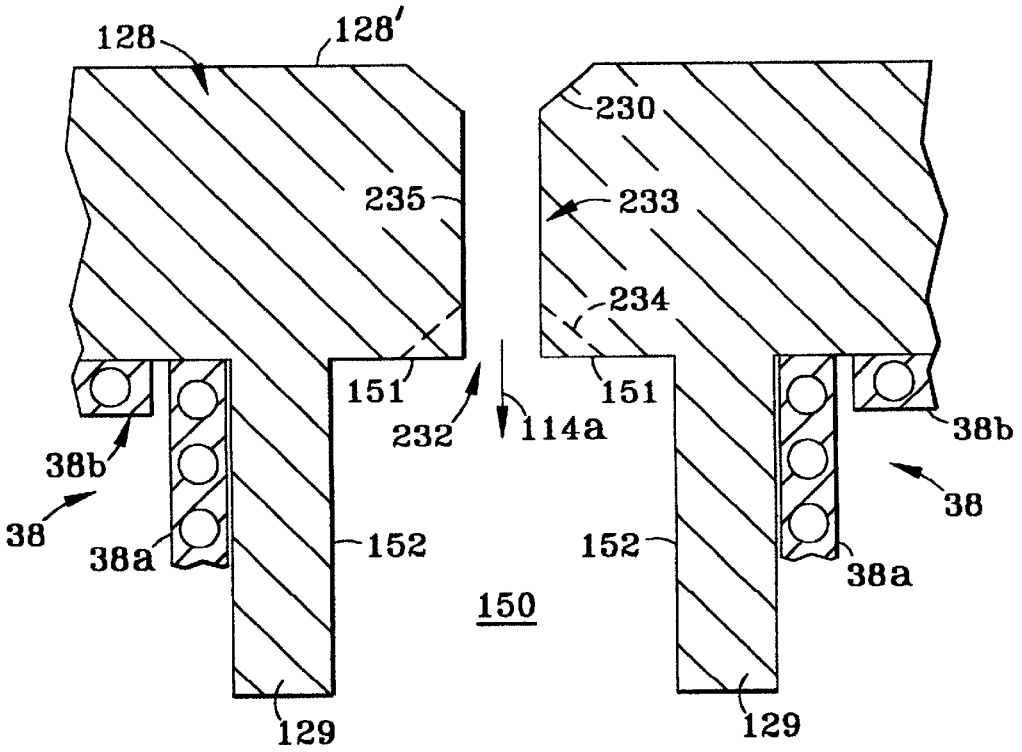
FIG. 7 is a schematic, partial section detailed illustration of another discharge guide tube for a method, as embodied by the invention.

FIG. 7 is a part-sectional illustration of another central orifice 232 within the scope of the invention. In FIG. 7, similar reference characters that are used in the above figures are used to reference like features. The central orifice 232 is formed in a base plate 128 of a discharge guide tube 22 and comprises an internal configuration with a profile that concentrates electromagnetic flux and heat, to the stream of liquid melt that flows therethrough. The central orifice 232 comprises an angled and stepped profile about a central longitudinal axis 138 of the central orifice 232.

The base plate 128 comprises and is formed in a similar manner as the above-described base plate 28, however, the base plate 128 includes an extension 129 that defines a base plate chamber 150. The base plate chamber 150 is bounded by an upper wall 151 and side walls 152. The central orifice 232 extends from the electroslag refining apparatus 10 to the wall 151 of the base plate 128. The stepped and angled profile of the central orifice 232 can be formed by an inclined central orifice ramp portion 230 that extends from a surface 128' of the base plate 128 to a constriction 233 in the central orifice 232. The constriction 233 may comprise a single constriction portion 235 (solid lines in FIG. 7) that extends over the entire central orifice 232 length and may terminate at the wall 151. Thus, the stream 114*a* flows into the chamber 150. Alternatively, the constriction 233 may comprise a constriction portion 235 that extends partially down the central orifice 232 length, and widens into an inclined portion 234 (broken lines in FIG. 7) that in turn terminates at the wall 151.

The configuration of the central orifice 232 at which the constriction 233 is formed can comprise any appropriate configuration that can produce the concentrations of electromagnetic field. The angles for the inclined central orifice ramp portion 230 and 234 can comprise any angles that form the constriction 233. The lengths of the inclined central orifice ramp portions 230 and 234 can be equal. Alternatively, lengths of the inclined central orifice ramp portions 230 and 234 need not be equal. Further, the length of the constriction portion 235 may vary. Also, the positioning of the constriction portion 235 in the central orifice 232 may vary. For example, the positioning of the constriction portion 235 may be equi-spaced in the central orifice 232, be disposed closer to the electroslag refining apparatus 10 than an exit from the central orifice 232, or be disposed closer to the exit from the central orifice 232 than to the electroslag refining apparatus 10. Accordingly, the positioning and configuration of the features of the central orifice 232 to produce, electromagnetic flux and heating can vary, as long as the intended purpose of the invention is accomplished.

The discharge guide tube 22 may be used in cooperation with an electroslag refining apparatus 10, as illustrated in FIG. 1. The discharge guide tube 22 can be used in conjunction with any subsequent processing of the stream of liquid refined melt 14*a* that is discharged from the electroslag refining apparatus 10. For example, and in no way limiting of the invention, atomizing structure may be provided for injecting a suitable atomizing gas from a gas supply to atomize the stream 114*a* of liquid refined melt 14*a* discharged from the central orifice 32, as embodied by the invention. Alternatively, the discharge guide tube 22 may be used in cooperation with device as set forth in U.S. Pat. No. 5,381,847 to Ashok et al.

Figure 8:
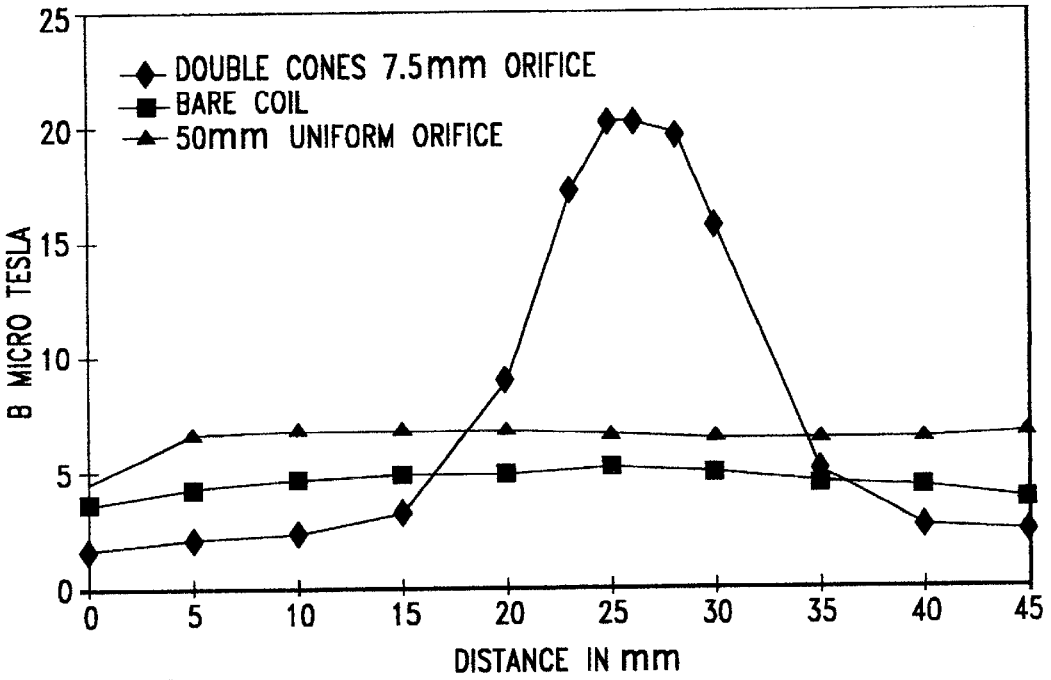
FIG. 8 is a graph of field intensity versus cold-walled induction guide tube axial tube distance.

FIG. 8 is a graph of field intensity versus guide tube axial distance for a discharge melt guide, as embodied by the invention. The discharge guide tube that is graphed in FIG. 8 comprises a four-turn induction heater coil structure. The coils carry about 87 mA at about 143,000 Hz. The generated electromagnetic field along the axis 138 is measured with a search coil in order to determine the field in the central orifice 32. In the figure, alternating current magnetic fields are measured for a simple coil, a straight un-constricted discharge guide tube configuration as set forth in U.S. Pat. No. 5,809,057, and a discharge guide tube configuration, as embodied by the invention. As illustrated in FIG. 8, the discharge guide tube configuration provides a clear enhancement of the generated electromagnetic field.

While various embodiments are described herein, it will be appreciated from the specification that various combinations of elements, variations or improvements therein may be made by those skilled in the art, and are within the scope of the invention.

What is claimed is:

1. A method for refining metal comprising:

contacting an unrefined metal with a slag in a vessel with a discharge tube;

passing a current through the slag to cause the metal to melt to a liquidus condition; and directing an electromagnetic flux from an exterior wall of the discharge tube along a concentrating configuration for producing concentrations of the electromagnetic flux to a central orifice of the discharge tube to generate heat that controls the liquidus condition of the melted metal as it is discharged from the vessel through the discharge tube.

2. The method of claim 1, further comprising configuring an interior wall of the discharge tube to vary application of generated heat within the tube.

3. The method of claim 2, wherein the interior wall is configured according to an angled and stepped profile.

4. The method of claim 2, wherein the interior wall is configured with a first central orifice portion;

a second central orifice portion;

a reduced diameter central orifice portion;

a first inclined central orifice ramp portion; and a second inclined central orifice ramp portion;

wherein the first inclined central orifice ramp portion extends from the first central orifice portion to the reduced diameter central orifice portion, and the second inclined central orifice ramp portion extends from the reduced diameter central orifice portion to the second central orifice portion.

5. The method of claim 1, further comprising configuring a slotted discharge tube to concentrate application of the flux to various areas of the discharge tube.

6. The method of claim 1, further comprising:

applying an electromagnetic field along an exterior wall of a tube equal distance from the tube center to generate heat within the tube; and configuring an interior wall of the tube to vary application of generated heat within the tube.

7. The method of claim 6, comprising applying the electromagnetic field by configuring the tube with an exterior cylindrical wall and applying the electromagnetic field uniformly along the exterior wall.

8. The method of claim 1, comprising configuring a base plate of the discharge tube with a radially extending slot to guide electromagnetic flux from the exterior wall of the discharge tube to the central orifice of the discharge tube.

9. The method of claim 8, comprising configuring the base plate with a plurality of spaced apart radially extending slots.

10. The method of claim 8, comprising configuring the base plate with a plurality of equiangularly, circumferentially spaced apart radially extending slots.

* * * * *